US012419400B2

(12) United States Patent
Yang

(10) Patent No.: US 12,419,400 B2
(45) Date of Patent: Sep. 23, 2025

(54) PULL ROD AND SUITCASE

(71) Applicant: GUANGDONG JINRUI TRAVEL PRODUCTS CO., LTD., Qingyuan (CN)

(72) Inventor: Haiyin Yang, Qingyuan (CN)

(73) Assignee: GUANGDONG JINRUI TRAVEL PRODUCTS CO., LTD., Qingyuan (CN)

( * ) Notice: Subject to any disclaimer, the term of this patent is extended or adjusted under 35 U.S.C. 154(b) by 113 days.

(21) Appl. No.: 18/239,765

(22) Filed: Aug. 30, 2023

(65) Prior Publication Data

US 2025/0009098 A1 Jan. 9, 2025

(30) Foreign Application Priority Data

Jul. 4, 2023 (CN) ..... 202321745539.0

(51) Int. Cl.
*A45C 13/26* (2006.01)
*A45C 5/03* (2006.01)

(52) U.S. Cl.
CPC ..... *A45C 13/262* (2013.01); *A45C 5/03* (2013.01); *A45C 2013/267* (2013.01)

(58) Field of Classification Search
CPC ... A45C 13/262; A45C 5/03; A45C 2013/267; A45C 13/26; A45C 13/28; A45C 2200/20
See application file for complete search history.

(56) References Cited

U.S. PATENT DOCUMENTS

| | | | | |
|---|---|---|---|---|
| 8,991,575 | B2 * | 3/2015 | Nebeling | A45C 5/14 190/102 |
| 2012/0067683 | A1 | 3/2012 | Cummins | |
| 2013/0153351 | A1 | 6/2013 | House, III | |
| 2016/0022032 | A1 | 1/2016 | Simon | |
| 2016/0227949 | A1 | 8/2016 | Klugh et al. | |
| 2020/0253348 | A1 * | 8/2020 | Majhess | A45C 5/14 |
| 2021/0093064 | A1 * | 4/2021 | Roosen | A45C 13/26 |
| 2021/0282520 | A1 * | 9/2021 | Weng | A45C 13/262 |

FOREIGN PATENT DOCUMENTS

| | | | | |
|---|---|---|---|---|
| CA | 3139484 | A1 * | 5/2022 | A45C 13/001 |
| CN | 202286726 | U | 7/2012 | |
| CN | 103536010 | A | 1/2014 | |
| CN | 203505798 | U | 4/2014 | |
| CN | 206252031 | U * | 6/2017 | |

(Continued)

OTHER PUBLICATIONS

CN 203505798 (English Translation) (Year: 2025).*

(Continued)

*Primary Examiner* — Nathan J Jenness
*Assistant Examiner* — Justin Caudill

(57) ABSTRACT

A pull rod and a suitcase are provided. The pull rod includes a link assembly, a handle assembly, and a supporting member. The handle assembly is disposed on the link assembly, and the handle assembly includes a first handle and a second handle arranged at intervals along a first preset direction. The supporting member is disposed on the handle assembly, a side of the supporting member facing the link assembly is concave, and a storage space is defined between the supporting member, the first handle and the second handle.

13 Claims, 4 Drawing Sheets

(56) References Cited

FOREIGN PATENT DOCUMENTS

| | | | | |
|---|---|---|---|---|
| CN | 107259744 | Y | | 10/2017 |
| CN | 109431041 | A | | 3/2019 |
| CN | 209750140 | Y | | 12/2019 |
| CN | 210054931 | A | | 2/2020 |
| CN | 113925271 | A | * | 1/2022 |
| CN | 217065590 | U | * | 7/2022 |
| JP | 3208872 | U | | 2/2017 |
| JP | 202050206 | A | | 4/2020 |
| KR | 2020120008829 | | | 12/2012 |

OTHER PUBLICATIONS

Notice of Reasons for Refusal of JP2023-159210.
International Search Report of PCT/CN2023/114610.
European search report of EP23194714.4.

* cited by examiner

PULL ROD AND SUITCASE

CROSS-REFERENCE TO RELATED APPLICATIONS

This application claims priority to Chinese patent application No. 202321745539.0, filed on Jul. 4, 2023, titled "PULL ROD AND SUITCASE", which is hereby incorporated by reference.

TECHNICAL FIELD

The present disclosure generally relates to a field of a suitcase, and in particular, to a pull rod for a suitcase and a suitcase.

BACKGROUND

When people travel or have a vacation, it may be inconvenient for them to hold a beverage bottle or a coffee cup while pulling a pull rod of a suitcase.

For the suitcase in the related art, a side of the suitcase or a side of the pull rod is provided with a holder to accommodate the bottle or the cup. However, when a user pulls the suitcase to walk, legs of the user are easy to collide with the holder, so that it is inconvenient to use the suitcase. In addition, when the bottle or the cup is accommodated in the holder on the side of the suitcase, the user needs to crouch down to reach the bottle or the cup due to a height limitation of the suitcase, and the bottle and the cup are easily forgotten.

SUMMARY

According to various embodiments of the present disclosure, a pull rod and a suitcase are provided.

The present disclosure provides a pull rod, including a link assembly, a handle assembly, and a supporting member. The handle assembly is disposed on the link assembly, and the handle assembly includes a first handle and a second handle arranged at intervals along a first preset direction. And the supporting member is disposed on the handle assembly, a side of the supporting member facing the link assembly is concave, and a storage space is defined between the supporting member, the first handle and the second handle.

In some embodiments, the handle assembly further includes at least two connecting members. Two ends of each of the at least two connecting members are connected to the first handle and the second handle, respectively. And the at least two connecting members are arranged at intervals along a second preset direction.

In some embodiments, the supporting member includes a U-shaped supporting portion and two connecting portions, and the two connecting portions are connected to the supporting portion. And ends of the two connecting portions away from the supporting portion are connected to the two connecting members, respectively.

In some embodiments, a distance between the first handle and the second handle is denoted as a, and the distance a between the first handle and the second handle is greater than or equal to 50 millimeters and less than or equal to 80 millimeters. A distance between the two connecting members is denoted as b, and the distance b between the two connecting members is greater than or equal to 100 millimeters and less than or equal to 200 millimeters. And a depth of the storage space is denoted as c, and the depth c of the storage space is greater than or equal to 10 millimeters and less than or equal to 60 millimeters.

In some embodiments, the supporting portion is provided with a first groove configured for accommodating an electronic device.

In some embodiments, a width of the first groove along the first preset direction is denoted as d, and the width d of the first groove along the first preset direction is greater than or equal to 10 millimeters and less than or equal to 15 millimeters. A length of the first groove along the second preset direction is denoted as e, and the length e of the first groove along the second preset direction is greater than or equal to 60 millimeters and less than or equal to 190 millimeters. And a depth of the first groove is denoted as f, and the depth f of the first groove is greater than or equal to 5 millimeters and less than or equal to 25 millimeters.

In some embodiments, in the same position of each of the at least two connecting members is provided with a second groove. The second groove is configured for accommodating an electronic device. And two ends of the second groove extend along the second preset direction to an edge of the corresponding connecting member.

In some embodiments, a width of the second groove along the first preset direction is denoted as g, and the width g of the second groove along the first preset direction is greater than or equal to 10 millimeters and less than or equal to 15 millimeters. And a depth of the second groove is denoted as h, and the depth h of the second groove is greater than or equal to 12 millimeters and less than or equal to 38 millimeters.

In some embodiments, an inner surface of the second groove proximal to the second handle is a slope.

In some embodiments, a tilt angle of the slope is denoted as θ, and the tilt angle θ of the slope is greater than or equal to 0 and less than or equal to 25 degrees.

In some embodiments, a side surface of the second handle facing the storage space is provided with a plurality of concave portions.

In some embodiments, the pull rod is further provided with a hanger disposed on the handle assembly and/or the supporting member.

In some embodiments, the link assembly is provided with a telescopic rod, and the handle assembly is disposed on a telescopic end of the telescopic rod.

The present disclosure further provides a suitcase, including a case body and a pull rod mentioned above, and the pull rod is disposed on the case body.

In some embodiments, the case body is provided with an accommodating groove configured to accommodate the handle assembly and the supporting member, and a size of the accommodating groove is greater than or equal to a size of the handle assembly and the support member.

In this way, the accommodating groove can prevent the handle assembly and the supporting member from protruding out of the case body to increase an overall size of the suitcase, so that the suitcase can have a greater capacity without increasing the overall size thereof. In addition, when the size of the accommodating groove is greater than the size of the handle assembly, there is a certain distance between the second handle and an inner wall of the accommodating groove, which is convenient for a user to grip the second handle.

The details of one or more embodiments of the present disclosure are set forth in the accompanying drawings and the description below. Other features, objects and advantages of the present disclosure will become apparent from the description, drawings and claims.

BRIEF DESCRIPTION OF THE DRAWINGS

In order to more clearly illustrate the technical solutions in the embodiments of the present disclosure or in the conventional technology, the following will briefly describe the accompanying drawings used in the description of the embodiments or conventional technology. It is obvious that for those of ordinary skill in the art, the accompanying drawings in the following description are only some embodiments of the present disclosure, and other drawings can be obtained according to these accompanying drawings without creative work.

Figure 1:
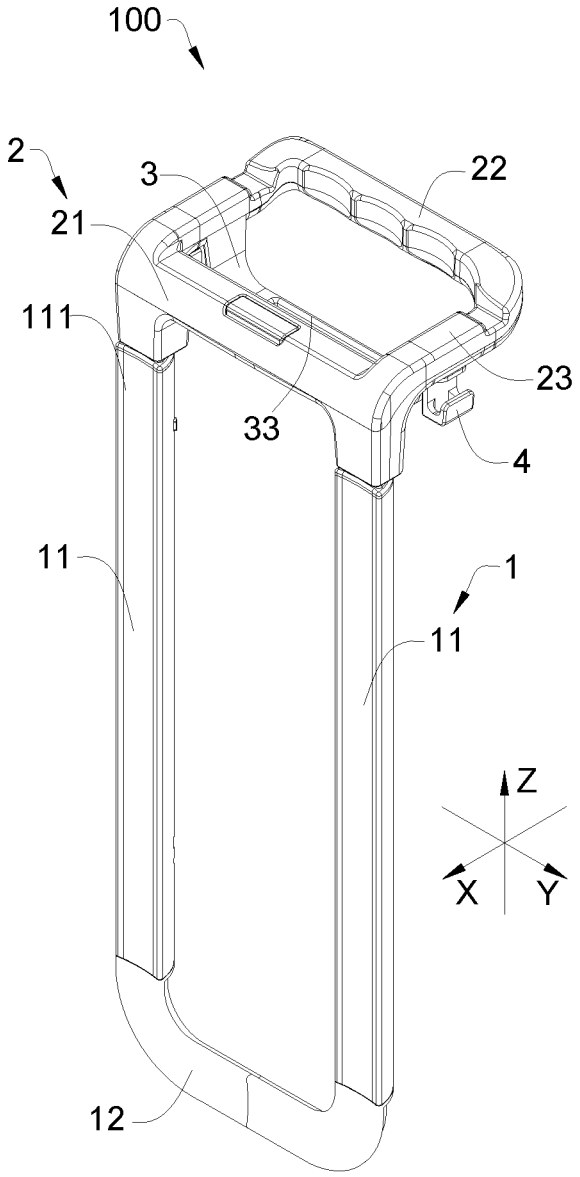
FIG. 1 is a schematic diagram of a pull rod according to some embodiments of the present disclosure.

In the figures, 100 represents a pull rod; 1 represents a link assembly; 11 represents a telescopic rod; 111 represents a telescopic end; 12 represents a connecting rod; 2 represents a handle assembly; 21 represents a first handle; 211 represents a button; 22 represents a second handle; 221 represents a concave portion; 23 represents a connecting member; 231 represents a second groove; 2311 represents a slope; 3 represents a supporting member; 31 represents a supporting portion; 311 represents a first groove; 32 represents a connecting portion; 33 represents a storage space; 34 represents an electronic device; 4 represents a hanger; 5 represents a case body; 51 represents an accommodating groove; 52 represents an assembly groove; and 200 represents a suitcase.

DETAILED DESCRIPTION OF THE EMBODIMENT

In order to make the above objects, features and advantages of the present disclosure obvious and easy to understand, the present disclosure is described in detail in the following with reference to the accompanying drawings. Many specific details are set out in the following description in order to fully understand the present disclosure. However, the present disclosure may be implemented in many other ways different from those described herein, and those skilled in the art may make similar improvements without violating the content of the present disclosure, so the present disclosure is not limited by the specific embodiments disclosed below.

It should be noted that when an element is referred to as being "fixed to" or "disposed on" another element, it may be directly fixed to or disposed on the other element or a further element may be presented between them. When an element is considered to be "connected" to another element, it may be directly connected to the other element or connected to the other element through a further element. The terms "vertical", "horizontal", "upper", "lower", "left", "right" and similar expressions used in this application are for illustrative purposes only and are not intended to be the only implementation.

In addition, the terms "first" and "second" are only used for descriptive purposes, and cannot be understood as indicating or implying relative importance or implying the number of indicated technical features. Thus, features delimited with "first", "second" may expressly or implicitly include at least one of the features. In the description of the present disclosure, unless expressly and specifically defined otherwise, "plurality" means at least two, such as two, three, etc.

In the present application, unless otherwise explicitly specified and defined, the expression a first feature being "on" or "underneath" a second feature may be the case that the first feature is in direct contact with the second feature, or the first feature is in indirect contact with the second feature via an intermediate medium. Furthermore, the expression the first feature being "over", "above" and "on top of" the second feature may be the case that the first feature is directly above or obliquely above the second feature, or only means that the level of the first feature is higher than that of the second feature. The expression the first feature being "under", "below" and "beneath" the second feature may be the case that the first feature is directly below or obliquely below the second feature, or only means that the level of the first feature is less than that of the second feature.

Unless otherwise defined, all technical and scientific terms used in the description of the present disclosure have the same meaning as a skilled person in the art would understand.

The terminology used in the description of the present disclosure is for the purpose of describing particular embodiments and is not intended to limit the disclosure. The term "or/and" as used herein includes any and all combinations of one or more of the associated listed items.

When people go outside, it may be necessary to hold a beverage bottle or a coffee cup while pulling a pull rod of a suitcase, which is inconvenient to move. For the suitcase in the related art, a side of the suitcase or a side of the pull rod is provided with a holder, and the bottle or the cup can be accommodated in the holder when a user is waiting or walking. However, when the user pulls the suitcase to walk, legs of the user are easy to collide with the holder, so that the suitcase is inconvenient to use. In addition, when the bottle or the cup is accommodated in the holder on the side of the suitcase, the user needs to crouch down to reach the bottle or the cup due to a height limitation of the suitcase, and the bottle and the cup are easy to forget.

Referring to FIG. 1 to FIG. 4, to solve the above problem, the present disclosure provides a pull rod 100. The pull rod 100 is convenient for the user to accommodate the bottle or the cup. In addition, the bottle or the cup is not easily forgotten and less prone to collide with the user, and it is convenient to use the pull rod 100.

Referring to FIG. 1 to FIG. 4, a first preset direction can be defined as a ±X-axis direction, a second preset direction can be defined as a ±Y-axis direction, and an extension direction of the link assembly 1 can be defined as a ±Z-axis direction.

Referring to FIG. 1, specifically, the pull rod 100 includes a link assembly 1, a handle assembly 2, and a supporting member 3. The handle assembly 2 is disposed on the link assembly 1, and the handle assembly 2 includes a first handle 21 and a second handle 22 arranged at intervals along the ±X-axis direction. The supporting member 3 is disposed on the handle assembly 2, a side of the supporting member 3 facing the link assembly 1 is concave, that is, the supporting member 3 is concave towards the −Z-axis direction. A storage space 33 is defined between the supporting member 3, the first handle 21 and the second handle 22, and the storage space 33 is capable of accommodating articles such as the bottle, the cup, and the like.

As mentioned above, in the suitcase of the related art, the side of the suitcase or the side of the pull rod is provided with the holder. When the user pulls the suitcase to walk, legs of the user are easy to collide with the holder, so that the suitcase is inconvenient to use. In the pull rod 100 provided in an embodiment of the present embodiment, articles such as the bottle, the cup, and the like can be accommodated in the storage space 33 defined between the supporting member 3, the first handle 21 and the second handle 22. The supporting member 3 is configured to support the bottle or the cup, the first handle 21, and the second handle 22 is configured to limit the bottle or the cup, thus preventing the bottle or the cup from falling. In this way, it is not necessary to hold the bottle or the cup at all times. Since the bottle or the cup is located between first handle 21 and second handle 22, when the user pulls the suitcase 200 to walk, legs of the user will not collide with the holder, so that it is convenient to use the suitcase 200. In addition, a height of the bottle or the cup accommodated in the storage space 33 is higher than a height of the bottle or the cup accommodated in the side of the suitcase 200. When the bottle or the cup is accommodated in the storage space 33, it is convenient for the user to reach the bottle or the cup. Moreover, the bottle or the cup is not easily forgotten.

In addition, in the pull rod 100 provided by the embodiment of the present disclosure, the first handle 21 and the second handle 22 can be configured to form the storage space 33 without an additional structure on the link assembly 1, thereby avoiding the link assembly 1 of the pull rod 100 occupying too much space on devices such as the suitcase 200. An internal capacity of the devices such as the suitcase 200 can be increased without increasing the overall size thereof.

Figure 2:
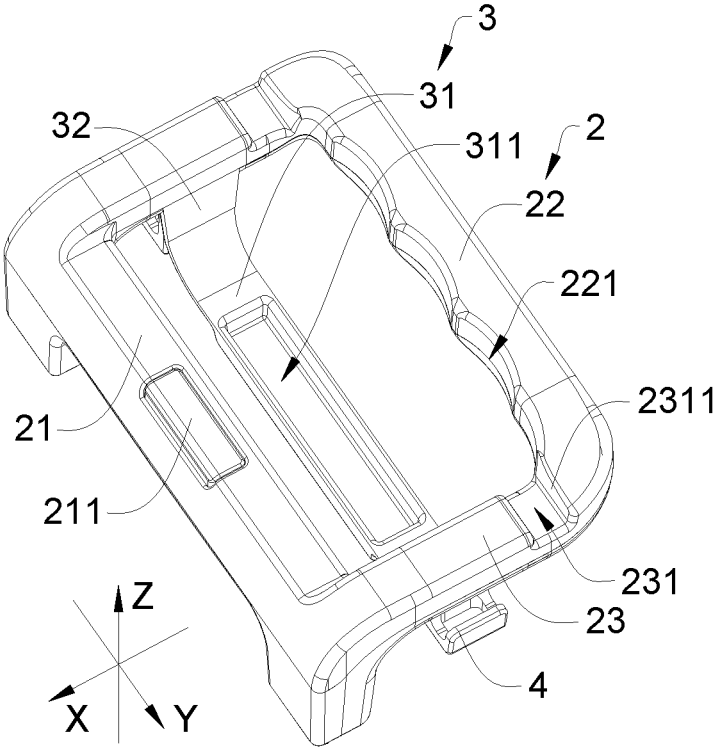
FIG. 2 is a schematic diagram of a handle assembly and a supporting member of the pull rod in FIG. 1 according to some embodiments of the present disclosure.

Referring to FIG. 1 and FIG. 2, in an embodiment, the link assembly 1 can include a connecting rod 12 and two telescopic rods 11 connected to both ends of the connecting rod 12, respectively. An end of each of the two telescopic rods 11 away from the connecting rod 12 can be defined as a telescopic end 111, and the telescopic end 111 can stretch out and draw back relative to the connecting rod 12 along the ±Z-axis direction. Two telescopic ends 111 of the two telescopic rods 11 can be connected to two ends of the first handle 21, respectively. The first handle 21 is provided with a button 211 for controlling the telescopic rod 11 to stretch out and draw back, and the user can press the button 211 and control the telescopic rod 11 to stretch out and draw back by the first handle 21. A height of the handle assembly 2 or the supporting member 3 can further be adjusted under a telescopic action of telescopic rod 11. When the user pulls a device such as the suitcase 200 by the first handle 21, the telescopic rod 11 is usually pulled up, and the bottle or the cup accommodated in storage space 33 will also be pulled up together with the handle 2 and the supporting member 3, which is convenient for the user to reach the bottle or the cup. When the telescopic rod 11 is in a contracted state, devices such as the suitcase 200 can be picked up by the second handle 22. Moreover, since compared with the first handle 21, the second handle 22 is proximal to the middle of the devices such as the suitcase 200, it can be ensured that devices such as the suitcase 200 can remain balanced when devices such as the suitcase 200 is picked up by the second handle 22.

In some embodiments, two telescopic ends 111 of the two telescopic rods 11 can be connected to the first handle 21 and the second handle 22, respectively. In addition, the two telescopic rods 11 can be disposed separately without being connected by the connecting rod 12. In other embodiments, the link assembly 1 may include a telescopic rod 11, and the telescopic end 111 of the telescopic rod 11 can be connected to a middle position of the first handle 21 or a middle position of the second handle 22, as long as strength of the pull rod 100 can be guaranteed.

Referring to FIG. 1, the handle assembly 2 can further include at least two connecting members 23, two ends of each of the at least two connecting members 23 can be connected to the first handle 21 and the second handle 22, respectively, and the at least two connecting members 23 can be arranged at intervals along the ±Y-axis direction. In the present embodiment, the handle assembly 2 can include two connecting members 23. The two connecting members 23 can be provided at both ends of the first handle 21, respectively, and provided at both ends of the second handle 22, respectively. The first handle 21, the second handle 22 and the two connecting members 23 can be enclosed to form a rectangular structure. The first handle 21 and the second handle 22 can be configured to limit a position of the bottle or the cup accommodated in the storage space 33 along the ±X-axis direction, and the two connecting members 23 can be configured to limit the position of the bottle or the cup accommodated in the storage space 33 along the ±Y-axis direction, thereby preventing the bottle or the cup from tipping or falling. In other embodiments, the handle assembly 2 may include three connecting members 23, four connecting members 23 or more than four connecting members 23, and one or more bottles or cups can be accommodated in adjacent two connecting members 23, as long as the position of the bottle or the cup can be limited, the present embodiment does not make specific restrictions herein.

Both between the connecting member 23 and the first handle 21, and between the connecting member 23 and the second handle 22 can be connected by an arc section. The arc section can avoid stress concentration and improve strength of the handle assembly 2, so that the pull rod 100 can meet a strength requirement of devices such as the suitcase 200.

Referring to FIG. 2, in an embodiment, the supporting member 3 can include a U-shaped supporting portion 31 and two connecting portions 32, and the two connecting portions 32 can be connected to the supporting portion 31. The supporting portion 31 can extend along the ±Y-axis direction, and ends of the two connecting portions 31 away from the supporting portion 31 can be connected to the two connecting members 23, respectively. The supporting portion 31 can be configured to support the bottle or the cup accommodated in the storage space 33. The two connecting portions 32 can be configured to be connected with the supporting portion 31 and the handle assembly 2, and further limit the position of the bottle or the cup, thus preventing the bottle or the cup from falling. The pull rod 100 may include a supporting member 3, and the supporting member 3 can be provided on a middle position of the connecting member 23, so that both between the supporting member 3 and the first handle 21 and between the supporting member 3 and the second handle 22 can leave a greater space. In this way, not only can the bottle or the cup accommodated in storage space 33 not fall, but it will not affect the user gripping the first handle 21 and the second handle 22. In other embodiment, the pull rod 100 may include a plurality of supporting members 3. A plurality of supporting members 3 can be arranged at intervals along the ±X-axis direction, as long as the supporting members 3 will not affect the user gripping the first handle 21 and the second handle 22, the present embodiment does not make specific restrictions herein.

In another embodiment, the supporting portion 31 can extend along the ±X-axis direction, and ends of the two connecting portions 31 away from the supporting portion 31 can be connected to the first handle 21 and the second handle 22, respectively. The pull rod 100 may include a supporting member 3, two supporting members 3 or more than two connecting members 23, and a plurality of supporting members 3 can be arranged at intervals along the ±Y-axis direction. Alternatively, the plurality of supporting member 3 may be cross-arranged, i.e., some supporting portions 31 can extend along the ±X-axis direction, the other supporting portions 31 can extend along the ±Y-axis direction, and a plurality of supporting portions 31 can be connected to each other in a cross shape. The connecting portion 32 corresponding to the supporting portion 31 which extends along the ±X-axis direction can be connected to the first handle 21 and the second handle 22. The connecting portion 32 corresponding to the supporting portion 31 which extends along the ±Y-axis direction can be connected to the two connecting members 23. As long as the bottle or the cup accommodated in storage space 33 cannot fall, and the supporting portion 31 will not affect the user gripping the first handle 21 and the second handle 22, the present embodiment does not make specific restrictions herein.

Figure 3:
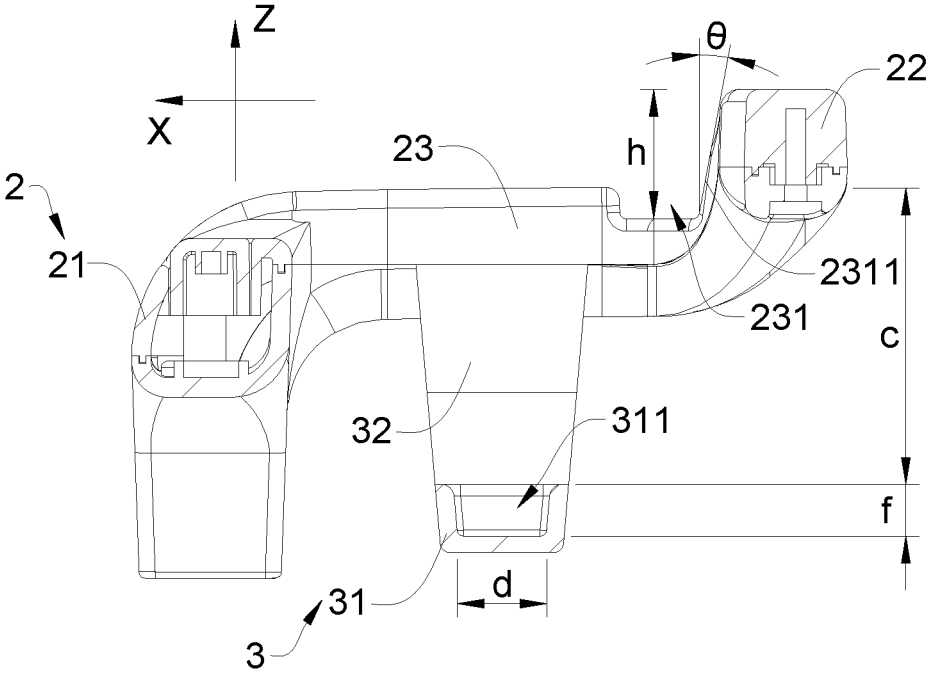
FIG. 3 is a sectional schematic diagram of the handle assembly and the supporting member of the pull rod in FIG. 2 according to some embodiments of the present disclosure.
Figure 4:
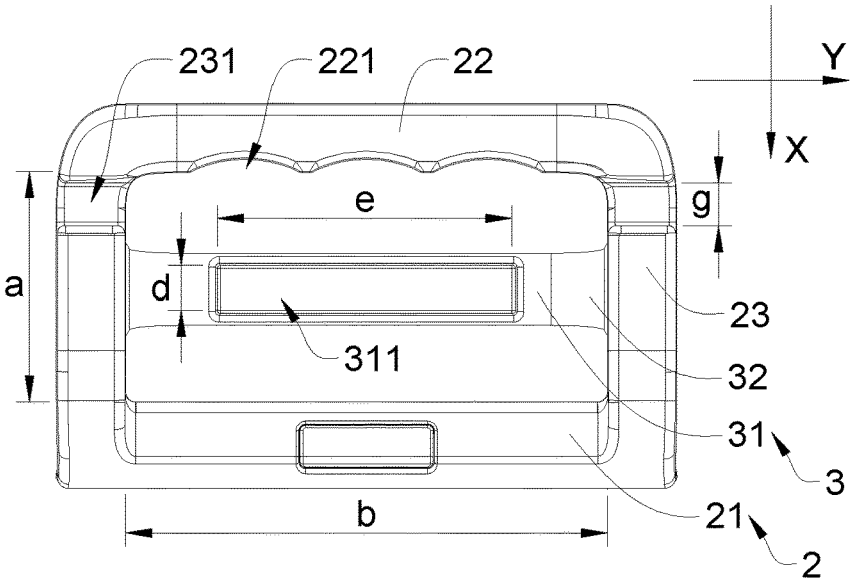
FIG. 4 is a schematic diagram of the handle assembly and the supporting member of the pull rod in FIG. 2 in top view according to some embodiments of the present disclosure.

Referring to FIG. 3 and FIG. 4, a distance between the first handle 21 and the second handle 22 can be denoted as a, and the distance a between the first handle 21 and the second handle 22 can be greater than or equal to 50 millimeters and less than or equal to 80 millimeters. In this way, the first handle 21 and the second handle 22 can be easily gripped by the user. In addition, bottles or cups with different diameters can be accommodated in the storage space 33, and the bottles or the cups can be less prone to shake significantly in the storage space 33. A distance between the two connecting members 23 can be denoted as b, and the distance b between the two connecting members 23 can be greater than or equal to 100 millimeters and less than or equal to 200 millimeters. In this way, when the bottle or the cup is accommodated in the storage space 33 vertically, two or more bottles or cups can be accommodated side by side in the storage space 33. Alternatively, shorter bottles or cans can be accommodated in the storage space 33 horizontally and suitable for a wide range of applications. A depth of the storage space 33 can be denoted as c, and the depth c of the storage space is greater than or equal to 10 millimeters and less than or equal to 60 millimeters. The depth c of the storage space 33 can be a size of the storage space 33 along the ±Z-axis direction. In this way, stability of the bottle or the cup when accommodated in the storage space 33 can be guaranteed, thus preventing the bottle or the cup from falling. Moreover, limiting the size of the storage space 33 in all directions can further prevent the pull rod 100 from being too great to take up too much space inside devices such as the suitcase 200.

Referring to FIG. 2, the supporting portion 31 can be provided with a first groove 311 configured for accommodating an electronic device 34. Since a center of gravity of the electronic device 34 such as a mobile phone or a tablet computer is relatively high, when the electronic device 34 is accommodated in the storage space 33 vertically, the electronic device 34 is prone to tip. Therefore, when the electronic device 34 such as the mobile phone or the tablet computer need to be used vertically, the electronic device 34 can be accommodated in the first groove 311. Since the storage space 33 has a certain depth, the electronic device 34 such as the mobile phone and the tablet computer can be accommodated in the first groove 311 and abut against the first handle 21 or the second handle 22, so as to ensure stability and safety of the electronic device 34 such as the mobile phone and the tablet computer, and prevent the electronic device 34 from tipping or falling.

Referring to FIG. 3 to FIG. 4, a width of the first groove 311 along the ±X-axis direction is denoted as d, and the width d of the first groove 311 along the ±X-axis direction can be greater than or equal to 10 millimeters and less than or equal to 15 millimeters. A length of the first groove 311 along the ±Y-axis direction is denoted as e, and the length e of the first groove 311 along the ±Y-axis direction can be greater than or equal to 60 millimeters and less than or equal to 190 millimeters. In this way, electronic devices 34 such as mobile phones or tablet computers with different widths and thicknesses or an electronic device 34 with a protective case can be accommodated in the first groove 311 and suitable for a wide range of applications. A depth of the first groove 311 can be denoted as f, and the depth f of the first groove 311 can be greater than or equal to 5 millimeters and less than or equal to 25 millimeters. The depth of the first groove 311 can be a size of the first groove 311 along the ±Z-axis direction. In this way, stability of the electronic device 34 such as the mobile phone and the tablet computer can be ensured when accommodated in the first groove 311, thus preventing the electronic device 34 from slipping. In addition, limiting the size of the first groove 311 along all directions can further prevent an overall size of the pull rod 100 from being too great due to a great size of the supporting portion 31, and prevent the first groove 311 from affecting the user gripping the first handle 21 and the second handle 22.

Figure 6:
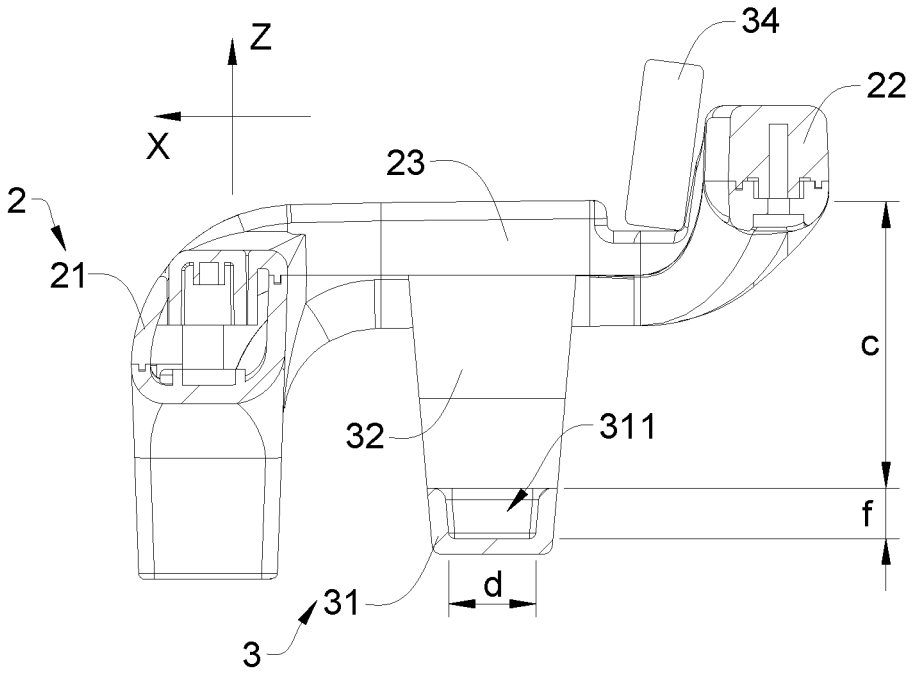
FIG. 6 is a sectional schematic diagram of the handle assembly and the supporting member of the pull rod in FIG. 2 according to some embodiments of the present disclosure.

Referring to FIG. 2 and FIG. 6, in the same position of each of the at least two connecting members 23 can be provided with a second groove 231, the second groove 231 can be configured for accommodating the electronic device 34, and two ends of the second groove 231 can extend along the second preset direction to an edge of the corresponding connecting member 23. When the electronic device 34 such as the mobile phone or the tablet computer need to be used horizontally, the electronic device 34 can be accommodated in the second groove 231. Since two ends of the second groove 231 extend to the edge of the corresponding connecting member 23, the second groove 231 cannot limit a size of the electronic device 34 along the ±Y-axis direction when the electronic device 34 is used horizontally. Furthermore, a plurality of connecting members 23 can improve stability of the electronic device 34 accommodated in the second groove 231, and prevent the electronic device 34 from tipping or falling.

Referring to FIG. 3 to FIG. 4, a width of the second groove 231 along the first preset direction can be denoted as g, and the width g of the second groove 231 along the first preset direction can be greater than or equal to 10 millimeters and less than or equal to 15 millimeters. In this way, electronic devices 34 such as mobile phones or tablet computers with different thicknesses or the electronic device 34 with the protective case can be accommodated in the second groove 231 and less prone to slip in the second groove 231. A depth of the second groove 231 can be denoted as h, and the depth h of the second groove 231 can be greater than or equal to 12 millimeters and less than or equal to 38 millimeters. In this way, stability of the electronic device 34 such as the mobile phone or the tablet computer accommodated in the second groove 231 can be guaranteed, thus preventing the electronic device 34 from tipping or falling. In addition, limiting a size of the second groove 231 along all directions can further prevent the overall size of the pull rod 100 from being too great due to a great size of the connecting member 23 or the second handle 22.

Referring to FIG. 3, in order to ensure that the devices such as the suitcase 200 can be picked up by the second handle 22, the second handle 22 needs to be flush with or slightly higher than the first handle 21, so that there is a certain gap between the second handle 22 and the devices such as the suitcase 200, so as to grip the second handle 22 by the user. When the first handle 21 needs to be flush with the second handle 22, the depth of the second groove 231 can be a size of inner surfaces of both sides of the second groove 231 along the Z-axis direction. When the second handle 22 is slightly higher than the first handle 21, the depth of the second groove 231 can be a size of an inner surface of the second groove 231 proximal to the second handle 22 along the Z-axis direction.

Referring to FIG. 2 to FIG. 3, the inner surface of the second groove 231 proximal to the second handle 22 can be a slope 2311. In this way, the electronic device 34 such as the mobile phone and the tablet computer can be accommodated in the second groove 231 and abut against the slope 2311. Not only can the slope 2311 ensure stability of the electronic device 34, but also improve comfort of the user. A tilt angle of the slope 2311 can be denoted as θ, and the tilt angle θ of the slope 2311 can be greater than or equal to 0 and less than or equal to 25 degrees. When the electronic device 34 such as the mobile phone or the tablet computer is tilted to the above angle range, a viewing effect of the screen of the electronic device 34 such as the mobile phone or the tablet computer of the user can be best and more comfortable.

Referring to FIG. 2 and FIG. 4, since the second handle 22 needs to be gripped by the user to pick up the device such as the suitcase 200 and device such as the suitcase 200 is usually heavier, a side surface of the second handle 22 facing the storage space 33 can be provided with a plurality of concave portions 221. The plurality of concave portions 221 can adapt to a hand shape of the user, making it more comfortable for the user to grip the second handle 22. In addition, when the bottle or the cup is accommodated in the storage space 33 vertically, the plurality of concave portions 221 can further able to limit the position of the bottle or the cup, thus prevent the bottle or the cup from sliding along the ±Y-axis direction. In other embodiments, the first handle 21 can further be provided with a plurality of concave portions 221, making it more comfortable for the user to grip the first handle 21.

Referring to FIG. 2, since it may be necessary to carry a bag while pulling the pull rod 100 of the suitcase 200 when people go out, the bag is prone to collide with the suitcase 200 or legs of the user, which is inconvenient for the user to move. The pull rod 100 can be further provided with a hanger 4 disposed on the handle assembly 2 and/or the supporting member 3. The hanger 4 can be configured to hang other articles such as the bag, and the articles hanging on the hanger 4 can be less prone to collide with the suitcase 200 or legs of the user, thus making it more convenient for the user to travel. The pull rod 100 may be provided with a hanger 4, two hangers or more than two hangers. Moreover, both the handle assembly 2 and the supporting member 3 can be provided with a hanger 4, as long as the hanger 4 does not interfere with other structures of the suitcase 200, the present embodiment does not make specific restrictions herein.

Figure 5:
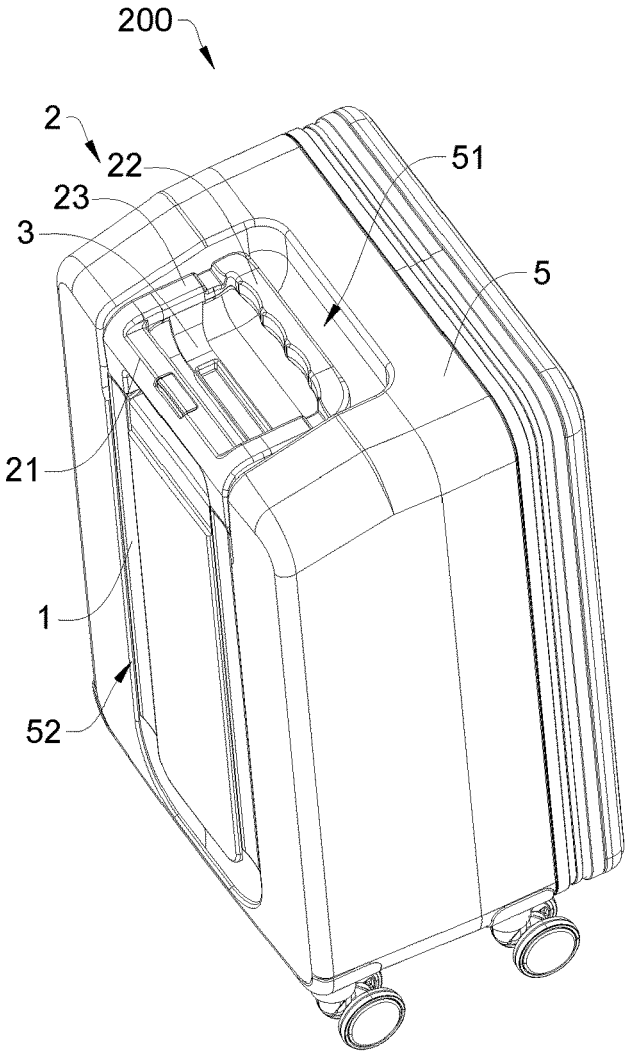
FIG. 5 is a schematic diagram of a suitcase according to some embodiments of the present disclosure.

Referring to FIG. 5, the present disclosure further provides a suitcase 200, including a case body 5 and the pull rod 100 mentioned above, and the pull rod 100 is disposed on the case body 5. One side of the case body 5 can be provided with an assembly groove 52 adapted to a shape of the link assembly 1. The link assembly 1 can be embedded in the assembly groove 52 to prevent the link assembly 1 from protruding from the case body 5 to increase the overall size of suitcase 200. Since the first handle 21 is connected to the link assembly 1, the case body 5 can be pushed by the user via the first handle 21. Since the second handle 22 is proximal to a middle position of the case body 5, the case body 5 can be picked by the user via the second handle 22 to ensure balance of the case body 5.

Referring to FIG. 5, the case body 5 can be provided with an accommodating groove 51 configured to accommodate the handle assembly 2 and the supporting member 3, and the accommodating groove 51 can be connected to and in communication with the assembly groove 52. A size of the accommodating groove 51 can be greater than or equal to a size of the handle assembly 2 and the support member 3. The accommodating groove 51 can prevent the handle assembly 2 and the supporting member 3 from protruding from the case body 5 to increase the overall size of suitcase 200. Since handles, wheels, etc. of the suitcase 200 are taken into account when the size of the suitcase 200 is calculated, the pull rod 100 does not protrude from the case body 5, so that the suitcase 200 can have a greater capacity without increasing the overall size thereof. Furthermore, when the size of the accommodating groove 51 is greater than the size of the handle assembly 2, there is a certain distance between the second handle 22 and the inner surface of the accommodating groove 51, which is convenient for the user to grip the second handle.

In other embodiments, the above-mentioned pull rod 100 can be applied in other devices with push and pull functions such as a trolley bag, a trolley stereo, a trolley and so on, the present disclosure does not limit herein.

The technical features of the above-described embodiments may be combined in any combination. For the sake of brevity of description, not all possible combinations of the technical features in the above embodiments are described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

What is claimed is:

1. A pull rod, comprising a link assembly, a handle assembly, and a supporting member, wherein the handle assembly is disposed on the link assembly, and the handle assembly comprises a first handle and a second handle arranged at intervals along a first preset direction, and the supporting member is disposed on the handle assembly, a side of the supporting member facing the link assembly is concave, and a storage space is defined between the supporting member, the first handle and the second handle;

the handle assembly further comprises at least two connecting members, two ends of each of the at least two connecting members are connected to the first handle and the second handle, respectively, and the at least two connecting members are arranged at intervals along a second preset direction;

the supporting member comprises a U-shaped supporting portion and two connecting portions, the two connecting portions are connected to the supporting portion, and ends of the two connecting portions away from the supporting portion are connected to the two connecting members, respectively.

2. The pull rod of claim 1, wherein a distance between the first handle and the second handle is denoted as a, and the distance a between the first handle and the second handle is greater than or equal to 50 millimeters and less than or equal to 80 millimeters, a distance between the two connecting members is denoted as b, and the distance b between the two connecting members is greater than or equal to 100 millimeters and less than or equal to 200 millimeters, and a depth of the storage space is denoted as c, and the depth c of the storage space is greater than or equal to 10 millimeters and less than or equal to 60 millimeters.

3. The pull rod of claim 1, wherein the supporting portion is provided with a first groove configured for accommodating an electronic device.

4. The pull rod of claim 3, wherein a width of the first groove along the first preset direction is denoted as d, and the width d of the first groove along the first preset direction is greater than or equal to 10 millimeters and less than or equal to 15 millimeters;

a length of the first groove along the second preset direction is denoted as e, and the length e of the first groove along the second preset direction is greater than or equal to 60 millimeters and less than or equal to 190 millimeters; and a depth of the first groove is denoted as f, and the depth f of the first groove is greater than or equal to 5 millimeters and less than or equal to 25 millimeters.

5. The pull rod of claim 1, wherein in the same position of each of the at least two connecting members is provided with a second groove, the second groove is configured for accommodating an electronic device, and two ends of the second groove extend along the second preset direction to an edge of the corresponding connecting member.

6. The pull rod of claim 5, wherein a width of the second groove along the first preset direction is denoted as g, and the width g of the second groove along the first preset direction is greater than or equal to 10 millimeters and less than or equal to 15 millimeters; and a depth of the second groove is denoted as h, and the depth h of the second groove is greater than or equal to 12 millimeters and less than or equal to 38 millimeters.

7. The pull rod of claim 5, wherein an inner surface of the second groove proximal to the second handle is a slope.

8. The pull rod of claim 7, wherein a tilt angle of the slope is denoted as θ, and the tilt angle θ of the slope is greater than or equal to 0 and less than or equal to 25 degrees.

9. The pull rod of claim 1, wherein a side surface of the second handle facing the storage space is provided with a plurality of concave portions.

10. The pull rod of claim 1, wherein the pull rod is further provided with a hanger disposed on the handle assembly and/or the supporting member.

11. The pull rod of claim 1, wherein the link assembly is provided with a telescopic rod, and the handle assembly is disposed on a telescopic end of the telescopic rod.

12. A suitcase, comprising a case body and the pull rod of claim 1, wherein the pull rod is disposed on the case body.

13. The suitcase of claim 12, wherein the case body is provided with an accommodating groove configured to accommodate the handle assembly and the supporting member, and a size of the accommodating groove is greater than or equal to a size of the handle assembly and the supporting member.

* * * * *